US006161698A

United States Patent [19]

Bradshaw et al.

[11] Patent Number: 6,161,698

[45] Date of Patent: Dec. 19, 2000

[54] GOLF BAG CARRYING CASE WITH CLUB HEAD PROTECTION AND METHOD FOR USING SAME

[75] Inventors: Bruce Bradshaw, Clarion, Iowa; Brian Walker, Seattle, Wash.

[73] Assignee: Team Effort, Inc., Clarion, Iowa

[21] Appl. No.: 09/136,850

[22] Filed: Aug. 19, 1998

(Under 37 CFR 1.47)

[51] Int. Cl.[7] ..... A63B 55/00; A63B 57/00; B65D 81/03

[52] U.S. Cl. ..... 206/527; 150/159; 206/315.4

[58] Field of Search ..... 150/159, 160; 206/315.2, 527, 315.4

[56] References Cited

U.S. PATENT DOCUMENTS

| | | | |
|---|---|---|---|
| 2,747,637 | 5/1956 | Brown | 150/159 |
| 4,657,135 | 4/1987 | Kjose | 206/315.4 X |
| 4,951,818 | 8/1990 | Johnson | 206/315.1 |
| 5,265,894 | 11/1993 | Dunn | 150/159 X |
| 5,383,305 | 1/1995 | Cordasco, Jr. | 150/159 |
| 5,515,897 | 5/1996 | Fehan | 150/159 |
| 5,810,064 | 9/1998 | Sanderson et al. | 150/159 |
| 5,862,910 | 1/1999 | Dahlsten | 150/159 X |

*Primary Examiner*—Sue A. Weaver

*Attorney, Agent, or Firm*—Zarley, McKee, Thomte, Voorhees & Sease

[57] ABSTRACT

A golf bag carrying case with club head protection and method for using same, for use in transporting a golf bag having golf clubs with clubheads. The carrying case includes an outer covering having a first end and second end and a cavity formed therein for storing the golf bag and a protective member disposed within the cavity near the top end for protecting the clubheads in the golf bag. In its preferred form, the protective member has a first end attached to the outer covering and the second end which is free and capable of being wrapped around the clubheads and shafts in the golf bag, thereby reducing or eliminating damage to the clubheads and shafts from impact during transport. The invention also includes a new zipper opening design which allows easy access to a golf bag stored within the carrying case.

16 Claims, 8 Drawing Sheets

GOLF BAG CARRYING CASE WITH CLUB HEAD PROTECTION AND METHOD FOR USING SAME

BACKGROUND OF THE INVENTION

1. Field of the Invention

The present invention relates to golf accessories. More particularly, though not exclusively, the present invention relates to a golf club carrying case for use in the transport of a golf bag with golf clubs.

2. Problems in the Art

Golf club carrying cases are well-known in the art. The purpose of the carrying case is to protect the golfer's bag and clubs during transport to and from the golf course. These golf club carrying cases are today a common sight at airports, as travelers try to protect their clubs and their golf accessories from damage caused by baggage handling.

Although prior art golf club carrying cases have many desirable features, they also suffer from several problems. The clubhead of the golf club is very susceptible to damage during transport. The shaft of the golf club extends into the golf bag, while the clubhead remains exposed outside of the golf bag.

During transport, the clubheads will often slide or knock against each other, scratching and marring the clubheads. Although some prior art golf bag carrying cases have provided additional padding where the clubheads normally reside, gaps between the clubheads still allow them to impact against each other. Thus, there is a need in the art for an improved system or device to protect the clubhead of a golf club during transport.

Another problem with prior art golf club carrying cases is that they do not allow easy access to the golf bag. For example, a golfer will often arrive at the golf course with the golf bag carrying case in the trunk of his vehicle. Because the golf bag can only be removed at a certain angle or from one end of the golf club carrying case, it is difficult to remove the golf bag and golf clubs from the golfer's trunk without also removing the carrying case. As such, there is also a need in the art for an improved golf club carrying case that allows for easier access to the golf bag.

Golf club carrying cases are also inherently bulky and heavy to lift. It is common today for a piece of luggage to include a pair of wheels attached to the base of the luggage so that it can be rolled during transport. However, these wheels do not roll smoothly under large loads and tend to malfunction. For this reason typical luggage wheels are not particularly well-suited for golf bag carrying cases. Thus, there is also a need in the art for an improved golf carrying case that can be easily wheeled from one place to another.

Golfers typically prefer a golf club carrying case made from a durable, light-weight material. One disadvantage to this material is that it does not maintain a rigid form, allowing the golfer to easily push or pull the carrying case on a pair of wheels. Accordingly, there is also a need in the art for an improved golf club carrying case that provides a rigid form such that the carrying case can be easily transported on a pair of wheels.

In addition to a golf bag and clubs, golfers also use a carrying case to store other golf accessories, such as golf shoes. A pouch is typically provided on the outside of the carrying case with a zipper opening. One disadvantage of this design is that the pouch is easily accessible to others during transport, increasing the risk of loss due to theft. As such there is also a need in the art for an improved golf bag carrying case that provides a secure place to store golf accessories.

FEATURES OF THE INVENTION

A general feature of the present invention is the provision of an improved golf bag carrying case which overcomes the problems found in the prior art.

A further feature of the present invention is the provision of a improved golf bag carrying case that protects the clubhead of the golf clubs.

A further feature of the present invention is the provision of an improved golf bag carrying case that allows for easy access and removal of the golf bag from the carrying case.

A still further feature of the present invention is the provision of an improved golf bag carrying case that may be easily transported on wheels.

A further feature of the present invention is the provision of an improved golf bag carrying case that allows access to golf shoes and other accessories from both the inside and outside of the carrying case.

A further feature of the present invention is the provision of a method for protecting the clubhead of the golf club stored in a golf bag during transport.

These as well as other features, objects, and advantages of the present invention will become apparent from the following specifications and claims.

SUMMARY OF THE INVENTION

The golf club carrying case of the present invention includes an elongated outer cover, having a top end and a bottom end and forming a cavity therein for storing the golf bag and golf clubs. A first protective member is disposed within the cavity near the top end to cushion and protect the clubheads in the golf bag.

In its preferred form, the protective member has a first end attached to the outer cover and a second end which is free and easily adapted to wrap around the clubheads and the golf bag. The golf bag carrying case may optionally include additional protective members that similarly wrap around the clubheads and shafts of the golf clubs.

The golf club carrying case of the present invention also includes a zipper opening that allows for easy access to the golf bag. The zipper opening has a first portion that extends transversely near the top end of the outer cover, a second portion that extends longitudinally between the top end and the bottom end of the outer cover, and a third portion that extends transversely across the outer cover near its bottom end. This C-shaped zipper opening allows the golf bag and clubs to be easily removed from the golf bag carrying case.

The present invention may also include at least one in-line skate wheel attached to the base member of the carrying case. Such in-line skate wheels roll easily and are capable of supporting large loads.

The present invention may also include a reinforcement wall and an elongated stiffener that extend from the base member towards the top end of the outer cover of the carrying case. This reinforcement wall and stiffener provide the carrying case with the necessary rigid form to enable the wheels to function properly during transport.

The present invention may also optionally include a storage pocket, recessed in the outer cover and accessible from either outside or inside of the carrying case.

Finally, the present invention also includes a method of protecting the clubhead of a golf club stored in a golf bag during transport. The method generally comprises the steps of providing a golf club carrying case as described above and wrapping the protective member around the clubheads of the golf clubs. The protective member takes up the space between the clubheads and also cushions their impact against one another.

DETAILED DESCRIPTION OF THE PREFERRED EMBODIMENT

The present invention will be described as it applies to its preferred embodiment. It is not intended that the present invention be limited to the described embodiment. It is intended that the invention cover all modifications and alternatives which may be included within the spirit and scope of the invention.

Figure 1:
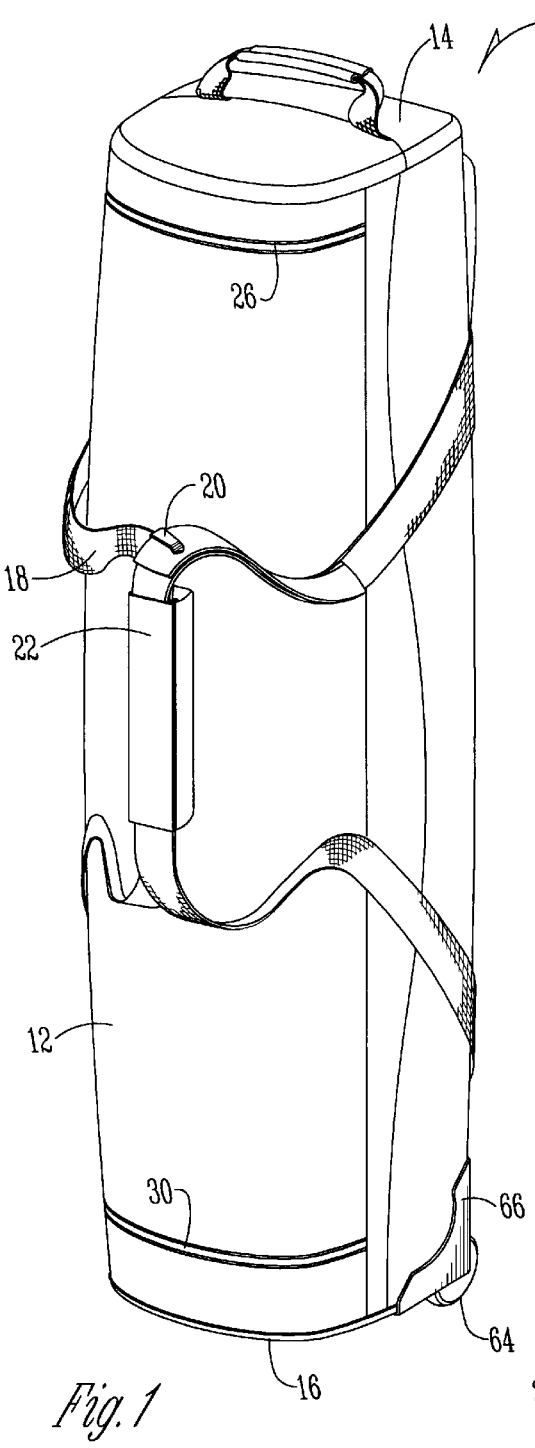
FIG. 1 is a perspective view of the golf bag carrying case of the present invention.

Now referring to the drawings, FIG. 1 shows the golf bag carrying case 10 of the present invention. The carrying case 10 includes an elongated outer cover 12 having a top end 14 and a bottom end 16. The outer cover is from preferably made from polyester or Cordura®. A pair of shoulder straps 18 are provided for lifting the carrying case 10. The straps 18 may be secured together with a clip 20 and bound by a padded member 22 intended to fit over the golfer's shoulder.

Figure 2:
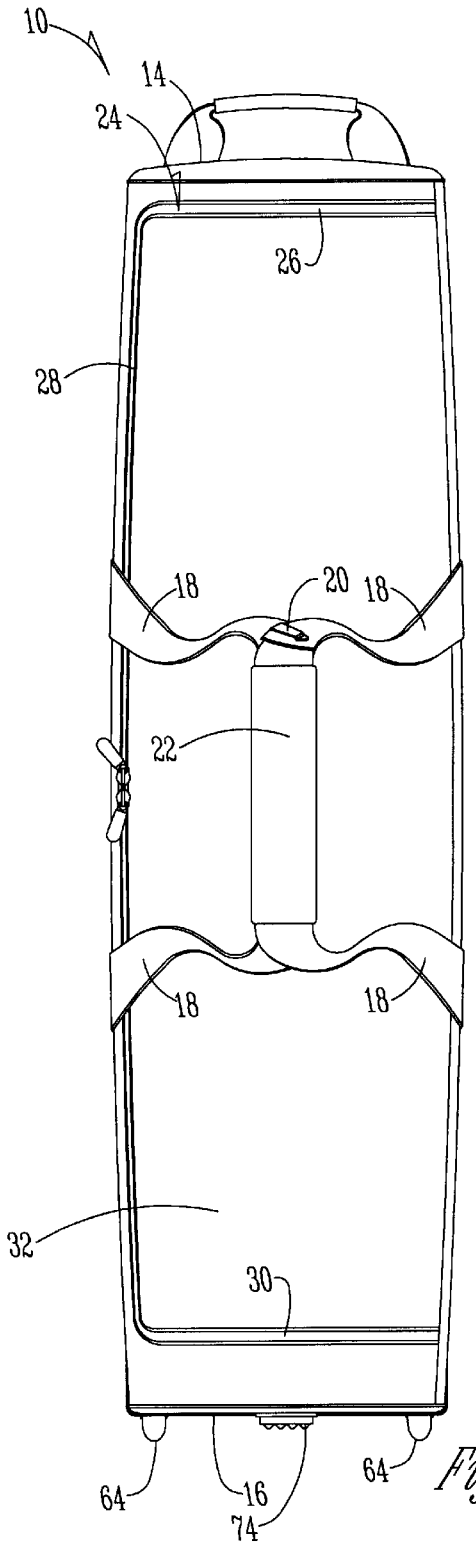
FIG. 2 is a front elevational view of the golf bag carrying case of FIG. 1.

As best shown in FIG. 2, the outer cover 12 of the carrying case 10 includes a zipper opening 24. The zipper opening 24 includes a first portion 26 that extends transversely across the outer cover 12 near the top end 14. A second portion 28 extends longitudinally between the top end 14 and the bottom end 16 of the outer cover 12, and a third portion 30 extends transversely back across the outer cover 12 near the bottom end 16. As such, the zipper opening 24 creates a C-shaped portion 32 of the outer cover 12. As illustrated in FIG. 2, the transverse portions 24 and 30 of the zipper opening 24 span the entire front side of the outer cover 10, providing a large opening to access the interior cavity 36.

Figure 3:
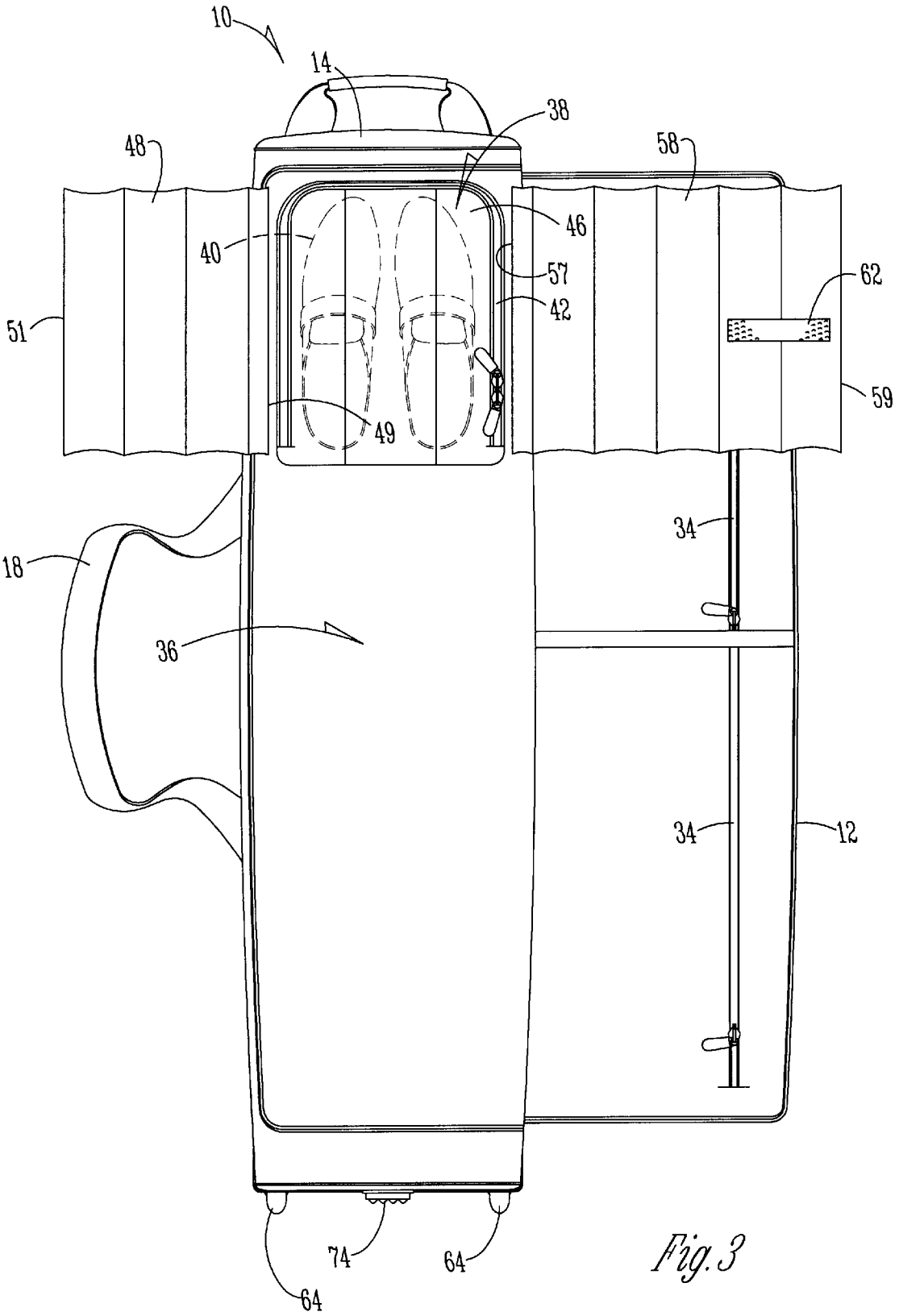
FIG. 3 is a front view of the carrying case in an open position.

FIG. 3 shows the carrying case 10 with the zipper opening 24 unzipped and the C-shaped portion 32 of the outer travel cover 12 extending from the carrying case in an open position. The interior side of the C-shaped portion 32 includes a pair of zipper openings 34 that provide access to miscellaneous storage pockets in the outer cover 12.

The outer cover 12 forms a cavity 36 therein for storing a golf bag and other golf accessories. As shown in FIG. 3, the outer cover 12 of the carrying case 10 also includes a recessed pocket 38 for storing golf shoes 40 or other golf accessories. This storage pocket 38 may be accessed from either the interior or exterior of the carrying case 10. An interior zipper opening 42 enables the golfer to access the pocket 38 from the interior of the carrying case 10. A zipper opening 44 is also provided on the exterior of the carrying case 10 (see FIG. 9). To prevent theft, the outer zipper opening 44 may remain locked with the golfer accessing the pocket 38 from the interior zipper opening 42. As described in greater detail below, the back wall 46 of the storage pocket 38 is formed of a padded material which helps protect the clubheads of the golf clubs during transport.

Figure 4:
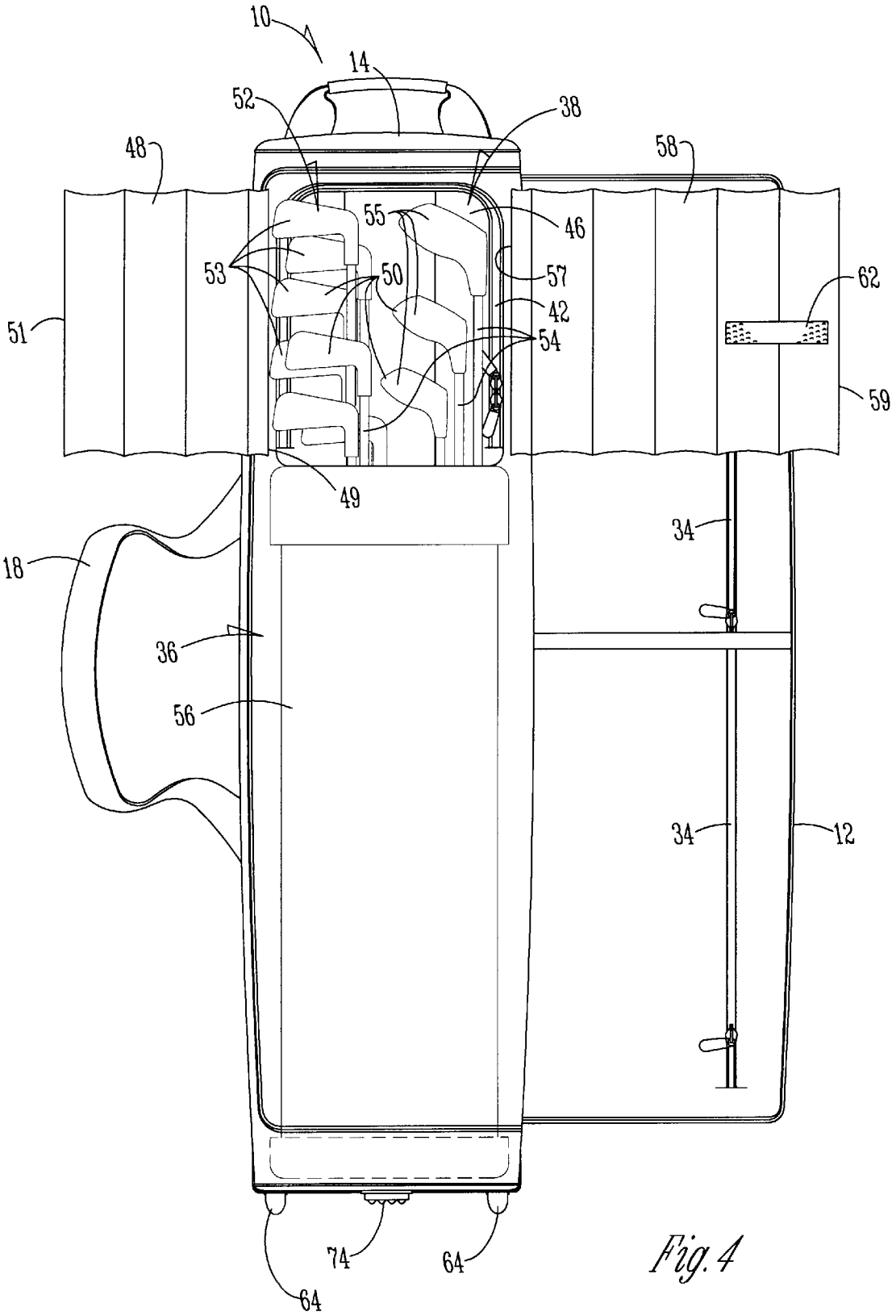
FIG. 4 is a view similar to FIG. 3, showing the golf bag and clubs disposed within the carrying case.

As best shown in FIGS. 3 and 4, the golf bag carrying case 10 of the present invention also includes a clubhead protection system. A first protective member 48 is disposed within the cavity 36 near the top end 14 of the outer cover adjacent the clubheads 50 of the golf clubs 52. The first protective member 48 is rectangular in shape and has a first end 49 attached to the interior of the outer cover and a second end 51 free.

A second protective member 58 is also provided opposite the first protective member 48. The second protective member is also rectangular in shape and has a first end 57 attached to the interior of the outer cover 12 and a second end 59 free.

Figure 5:
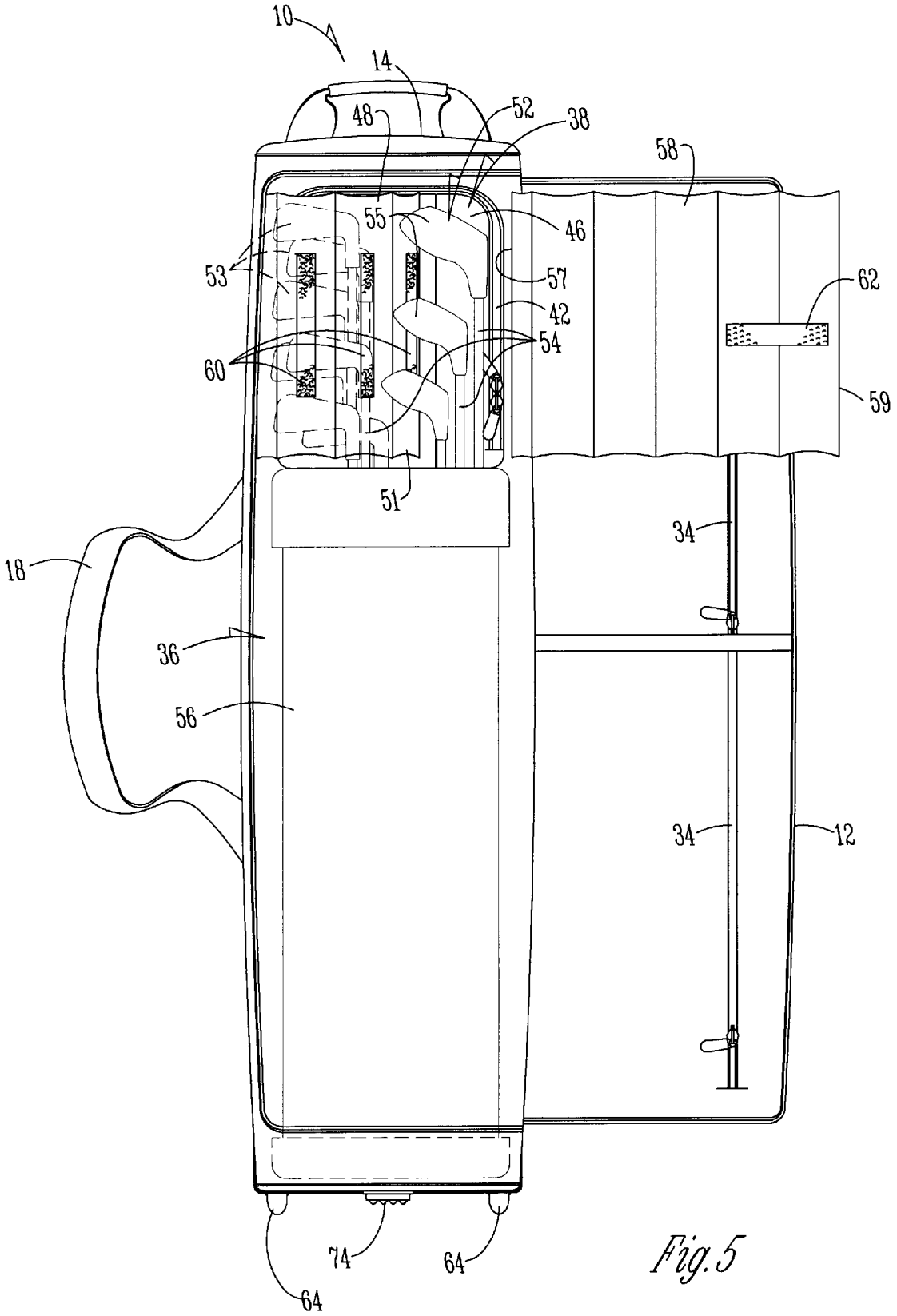
FIG. 5 is a view similar to FIG. 4, showing one protective member wrapped around the clubheads of the golf clubs.
Figure 6:
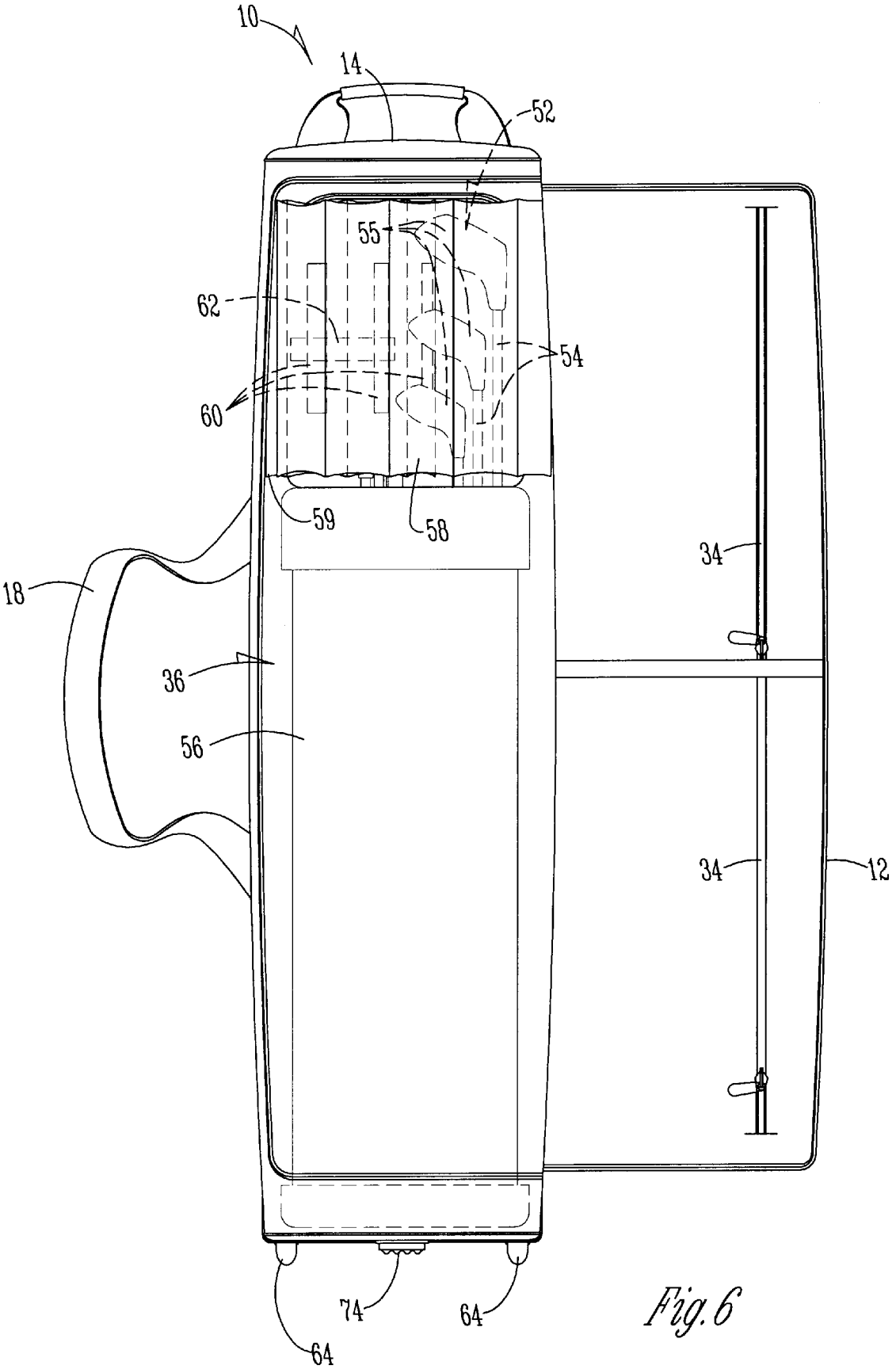
FIG. 6 is a view similar to FIG. 5, showing two protective members wrapped around the clubheads of the golf clubs.
Figure 12:
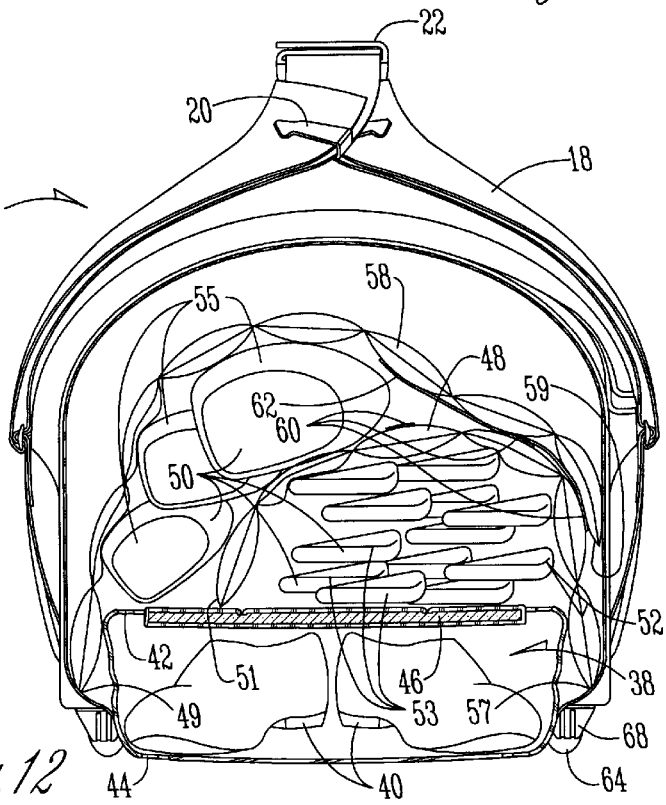
FIG. 12 is a sectional view, taken along line 12—12 of FIG. 7.

FIGS. 5, 6, and 12 best illustrate the operation and use of the first and second protective members 48 and 58. clubs 52 extend outside and above the golf bag 56. The golf clubs 52 include both irons 53 and woods 55. As shown in FIG. 5, the second end 51 of the first protective member 48 is wrapped around the irons 53 in the golf bag 56. As shown in FIGS. 6 and 12, the second end 59 of the second protective member 58 is then wrapped around the woods 55 and removably secured to the first protective member 48. It is preferred that a plurality of longitudinally spaced apart VELCRO® pads 60 be positioned on the outside of the first protective member 48 and a VELCRO® strip 62 positioned on the interior of the second protective member 58 orthogonal to the VELCRO® pads 60.

As best shown in FIG. 12, the first and second protective members 48 and 58 take up the space between the golf clubs 52 to prevent them from sliding around in the golf bag 56 during transport. The protective members 48 and 58 also provide padding between the golf clubs 52 to prevent marring and scratching of the clubheads 50. The first and second protective members 48 and 58 are made of a nylon construction, having open cell foam inserts. Other similar padding and packaging materials may be used.

Figure 7:
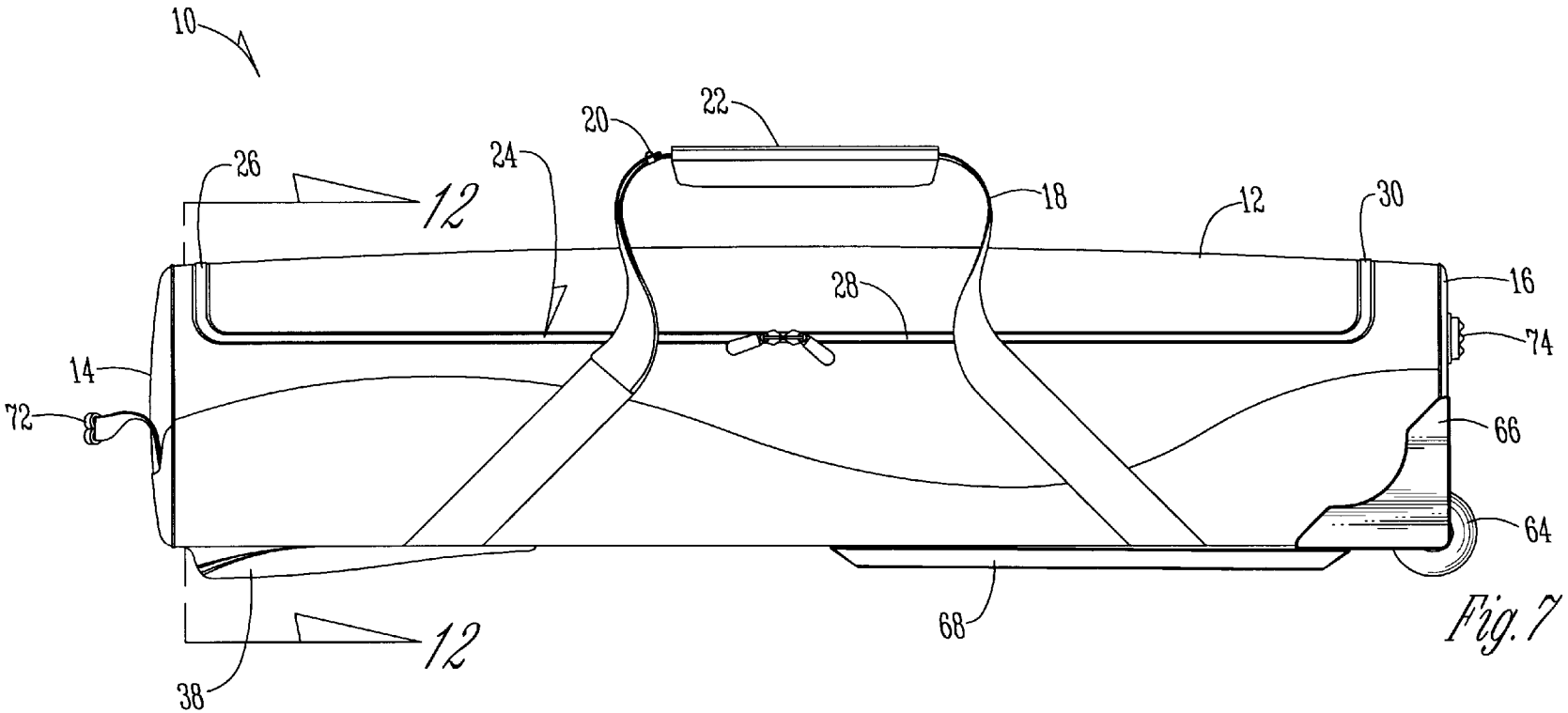
FIG. 7 is a side elevational view of the golf bag carrying case.
Figure 8:
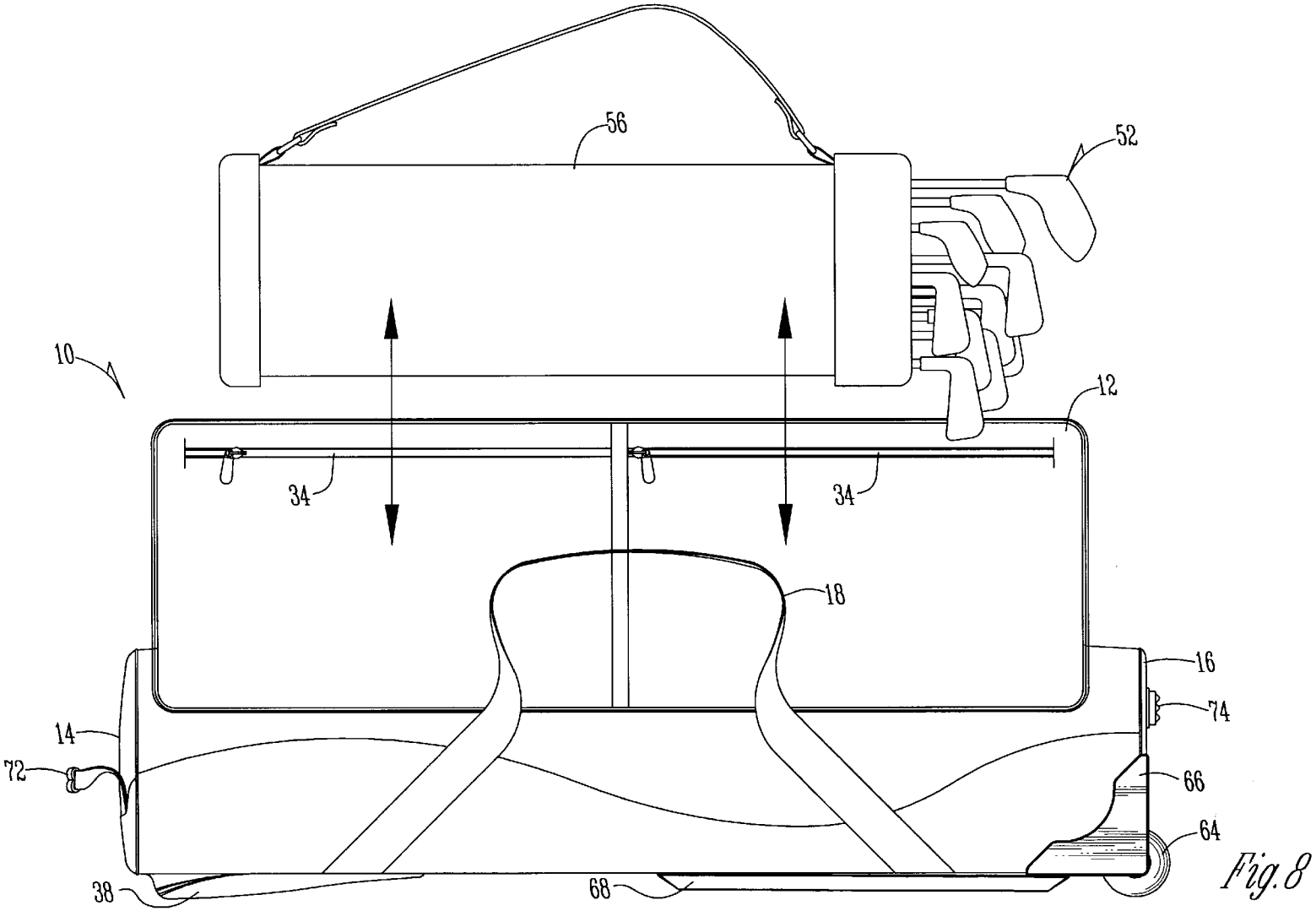
FIG. 8 is a side view of the carrying case in an open position, showing the removal of a golf bag.

FIGS. 7 and 8 illustrate how the golf bag 56 and golf clubs 52 may be easily removed from the carrying case 10. The zipper opening 24 is unzipped, and the C-shaped portion 32 of the outer cover 12 is extended from the carrying case 10. This provides for a large opening, spanning approximately the entire width of the front side of the carrying case, permitting the golf bag 56 to be easily removed. This allows the golf bag 56 and clubs 52 to be easily removed from the carrying case 10 without manipulating the carrying case. The golf bag 56 and golf clubs 52 may also be easily repositioned in the cavity 56 of the outer cover 12.

Figure 9:
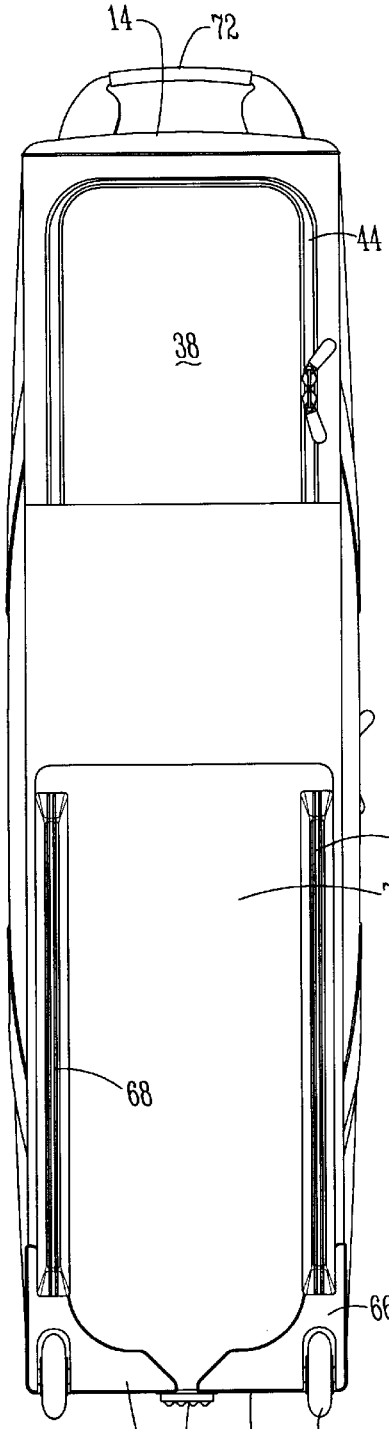
FIG. 9 is a back elevational view of the golf bag carrying case.
Figure 10:
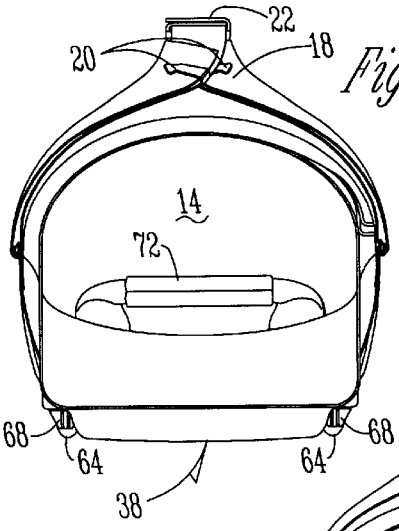
FIG. 10 is a top elevational view of the golf bag carrying case.
Figure 11:
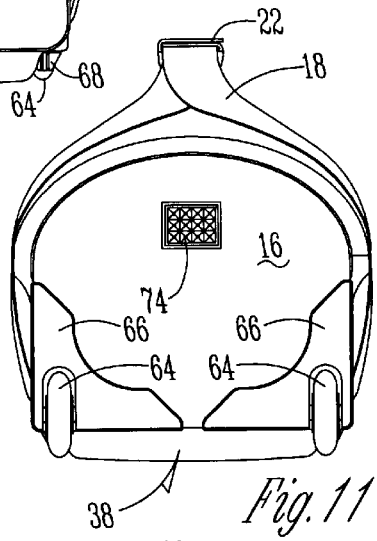
FIG. 11 is a bottom elevational view of the golf bag carrying case.

As shown in FIG. 9, the back side of the carrying case 10 includes a pair of wheels 64 positioned towards the bottom end 16 of the outer cover 12. A rigid pair of base members 66 provides the structure necessary to mount the wheels. The wheels 64 are preferably of the type used for in-line skating. Such wheels are better adapted to support large loads and allow the carrying case to roll smoothly across a ground surface.

The back side of the carrying case 10 also includes a pair of elongated stiffeners 68. The stiffeners 68 are spaced apart and extend between the top end 14 and the bottom end 16 of the outer cover 12. The stiffeners 68 are made of an injection mold material. The stiffeners 68 are mounted on opposite sides of a rectangular-shaped reinforcement wall 70 disposed on the interior of the outer cover 12 . The function of the stiffeners 68 and reinforcement wall 70 is to provide the carrying case 10 with the necessary rigidity such that it does not easily collapse during transport. This enables the golfer to more easily roll the carrying case 10 on a ground surface.

A handle 72 is provided for either pulling or pushing the carrying case on its wheels 64 during transport.

A texturized rubber pad 74 is also provided on the bottom side of the carrying case 10. The function of the pad 74 is to prevent the carrying case 10 from rolling when in an upright position.

From the foregoing, it can be seen that the present invention accomplishes at least all of its stated objectives.

What is claimed is:

1. A golf bag carrying case for use in transporting a golf bag having golf clubs with clubheads, comprising:

an elongated outer cover having a top end and a bottom end and forming a cavity therein for storing the golf bag with the clubheads disposed near the top end; and a first protective member disposed within the cavity near the top end and having a first end attached to the outer cover and a second end free, the first protective member being adapted to wrap around the clubheads for protecting the clubheads in the golf bag.

2. The golf bag carrying case of claim 1 further comprising a second protective member having a first end attached to said outer cover and a second end free, the second protective member being adapted to wrap around the clubheads and the first protective member.

3. The golf bag carrying case of claim 2 wherein the first ends of the first and second protective members are spaced apart along the outer cover so that the clubheads are positioned therebetween.

4. The golf bag carrying case of claim 1 further comprising a rigid base member connected to the bottom end of outer cover.

5. The golf bag carrying case of claim 4 further comprising at least one wheel connected to the base member.

6. The golf bag carrying case of claim 5 wherein the at least one wheel is an in-line skate wheel.

7. The golf bag carrying case of claim 5 further comprising at least one elongated stiffener extending from the base member toward the top end of the outer cover.

8. The golf bag carrying case of claim 1 further comprising a storage pocket recessed in the outer cover.

9. The golf bag carrying case of claim 8 wherein the outer cover includes a zipper opening for allowing access to the golf bag, the zipper opening having a first portion extending transversely across the outer cover near the top end of the outer cover, a second portion extending longitudinally between the top end and the bottom end of the outer cover, and a third portion extending transversely across outer cover near the bottom end of the outer cover.

10. The golf bag carrying case of claim 8 wherein the storage pocket is accessible from either a first zipper opening on the outer cover or a second zipper opening on the storage pocket within the cavity.

11. The golf bag carrying case of claim 8 wherein the storage pocket is disposed near the top end of the outer cover and the storage pocket includes a padded back wall for cushioning the clubheads.

12. A golf bag carrying case for use in transporting a golf bag having golf clubs with clubheads, comprising:

an elongated outer cover having a top end and a bottom end and forming a cavity therein for storing the golf bag with the clubheads disposed near the top end a first protective member disposed within the cavity near the top end and having a first end attached to the outer cover and a second and free, the first protective member being adapted to wrap around the clubheads for protecting the clubheads in the golf bag; and a zipper opening for allowing access to the golf bag, the zipper opening having a first portion extending transversely across the outer cover near the top end of the outer cover, a second portion extending longitudinally between the top end and the bottom end of the outer cover, and a third portion extending transversely across outer cover near the bottom end of the outer cover.

13. The golf bag carrying case of claim 12 wherein the zipper opening is substantially C-shaped.

14. A method of protecting the clubhead of a golf club stored in a golf bag during transport, comprising the steps of:

providing an elongated outer cover having a top end and a bottom end and forming a cavity therein for storing the golf bag with the clubheads disposed near the top end;

providing a first protective member disposed within the cavity near the top end for protecting the clubheads in the golf bag, the first protective member having a first end attached to said outer cover and a second end free, the first protective member being adapted to wrap around the clubhead in the golf bag;

placing the golf bag with one or more golf clubs therein in the outer cover with the clubhead of the golf club disposed near the top end; and wrapping the first protective member around the clubhead of the golf club.

15. The method of claim 14 further comprising the step of providing a second protective member having a first end attached to said outer cover and a second end free, the second protective member being adapted to wrap around the clubheads and the first protective member, and wrapping the second protective member around the clubhead and the first protective member.

16. The method of claim 15 wherein the first and second protective members include hook and loop fasteners mounted thereto and further comprising the step of detachably securing the second protective member to the first protective member using the hook and loop fasteners.

* * * * *